US009038603B2

(12) United States Patent
Ikoma et al.

(10) Patent No.: US 9,038,603 B2
(45) Date of Patent: May 26, 2015

(54) FASTENING STRUCTURE OF FUEL DELIVERY PIPE AND CYLINDER HEAD OF INTERNAL COMBUSTION ENGINE

(71) Applicants: Takuya Ikoma, Miyoshi (JP); Hiroyuki Maeda, Iwata (JP)

(72) Inventors: Takuya Ikoma, Miyoshi (JP); Hiroyuki Maeda, Iwata (JP)

(73) Assignees: Toyota Jidosha Kabushiki Kaisha, Toyota-shi, Aichi-ken (JP); Yamaha Hatsudoki Kabushiki Kaisha, Iwata-shi, Shizuoka-ken (JP)

( * ) Notice: Subject to any disclaimer, the term of this patent is extended or adjusted under 35 U.S.C. 154(b) by 0 days.

(21) Appl. No.: 14/353,960

(22) PCT Filed: Oct. 25, 2012

(86) PCT No.: PCT/IB2012/002139

§ 371 (c)(1),
(2) Date: Apr. 24, 2014

(87) PCT Pub. No.: WO2013/061135

PCT Pub. Date: May 2, 2013

(65) Prior Publication Data

US 2014/0305411 A1 Oct. 16, 2014

(30) Foreign Application Priority Data

Oct. 26, 2011 (JP) ..... 2011-235200

(51) Int. Cl.

| | |
|---|---|
| ***F02M 61/14*** | (2006.01) |
| ***F02M 55/02*** | (2006.01) |
| ***F02M 69/46*** | (2006.01) |

(52) U.S. Cl.
CPC ..... *F02M 61/14* (2013.01); *F02M 55/025* (2013.01); *F02M 69/465* (2013.01)

(58) Field of Classification Search
USPC ..... 123/470, 456, 469
See application file for complete search history.

(56) References Cited

U.S. PATENT DOCUMENTS

| | | | | |
|---|---|---|---|---|
| 5,735,247 | A * | 4/1998 | Tsuzuki et al. | 123/470 |
| 6,073,612 | A * | 6/2000 | Ohkubo et al. | 123/456 |
| 8,087,398 | B2 * | 1/2012 | Harvey et al. | 123/470 |
| 8,596,246 | B2 * | 12/2013 | Nishizawa et al. | 123/469 |
| 2001/0010217 | A1 | 8/2001 | Sato et al. | |
| 2003/0213472 | A1 * | 11/2003 | Suzuki et al. | 123/469 |
| 2009/0145504 | A1 * | 6/2009 | Colletti et al. | 138/89 |
| 2011/0108005 | A1 * | 5/2011 | Nishizawa et al. | 123/469 |

FOREIGN PATENT DOCUMENTS

| | | |
|---|---|---|
| JP | 4-124462 | 4/1992 |
| JP | 2000-120504 | 4/2000 |
| JP | 2006-226273 | 8/2006 |
| JP | 2007-154812 | 6/2007 |
| JP | 2007-255361 | 10/2007 |
| JP | 2010-59819 | 3/2010 |

* cited by examiner

*Primary Examiner* — Hung Q Nguyen
(74) *Attorney, Agent, or Firm* — Finnegan, Henderson, Farabow, Garrett & Dunner, LLP

(57) ABSTRACT

A fastening structure of a fuel delivery pipe and a cylinder head of an internal combustion engine includes three or more bosses provided on each of the cylinder head and the fuel delivery pipe, and fastening portions formed by bolting the bosses on the cylinder head to the bosses on the fuel delivery pipe. The fastening portions at both end portions of the fuel delivery pipe are less rigid than one or more fastening portions in a middle between the fastening portions positioned at both end portions of the fuel delivery pipe.

14 Claims, 5 Drawing Sheets

FASTENING STRUCTURE OF FUEL DELIVERY PIPE AND CYLINDER HEAD OF INTERNAL COMBUSTION ENGINE

CROSS-REFERENCE TO RELATED APPLICATIONS

This application is a national phase application of International Application No. PCT/IB2012/002139, filed Oct. 25, 2012, and claims the priority of Japanese Application No. 2011-235200, filed Oct. 26, 2011, the content of both of which is incorporated herein by reference.

BACKGROUND OF THE INVENTION

1. Field of the Invention

The invention relates to a fastening structure of a fuel delivery pipe and a cylinder head of an internal combustion engine.

2. Description of Related Art

A fuel delivery pipe that is provided with a plurality of injection nozzles in a cylinder head of an internal combustion engine, and that supplies fuel such as gasoline to a plurality of cylinders is known (see Japanese Patent Application Publication No. 2007-255361 (JP 2007-255361 A) (pp. 5 to 6 and FIG. 1), and Japanese Patent Application Publication No. 2000-120504 (JP 2000-120504 A) (p. 3 and FIG. 1), for example). In JP 2007-255361 A (pp. 5 to 6 and FIG. 1), when internal pressure in the fuel delivery pipe is added, high stress concentration is generated at a connecting portion where the fuel delivery pipe is connected to a socket provided near a center portion of the fuel delivery pipe, so the center portion of the fuel delivery pipe is reinforced with ribs to prevent an absorbing wall surface thereof from being damaged.

In JP 2000-120504 A (p. 3 and FIG. 1), a fuel delivery pipe is prevented from becoming axially offset from an injector due to a difference in thermal expansion caused by a temperature difference between the fuel delivery pipe and a cylinder head, by splitting up the fuel delivery pipe into sections and flexibly connecting the sections together. As a result, the sealing characteristic of a rubber O-ring at a portion where the injector and the fuel delivery pipe are connected is maintained.

A difference in material between the cylinder head and the fuel delivery pipe, or a temperature difference between the two, may result in a different degree of expansion between the two. For example, if the cylinder head is made of aluminum alloy and the fuel delivery pipe is made of iron alloy, the coefficient of linear expansion of the aluminum alloy is greater than the coefficient of linear expansion of the iron alloy, so the fuel delivery pipe receives force from the cylinder head that elongates the fuel delivery pipe when the internal combustion engine rises in temperature due to the internal combustion engine being operated. Conversely, when the temperature of the internal combustion engine is low, the fuel delivery pipe receives force from the cylinder head that shortens the fuel delivery pipe.

Even if the materials of the cylinder head and the fuel delivery pipe are the same, a temperature difference between the cylinder head and the fuel delivery pipe will similarly result in the fuel delivery pipe receiving forces from the cylinder head that cause it to become elongated and shortened.

When the fuel delivery pipe becomes deformed in this way, a sealing characteristic between the fuel injection valve and the fuel delivery pipe may decrease due to the entire fuel delivery pipe rebounding, or stress may concentrate at the fastening portion of the cylinder head and the fuel delivery pipe, which may cause the durability to decrease.

With the structure described in JP 2007-255361 A (pp. 5 to 6 and FIG. 1), the issue is deformation caused by the internal pressure of the fuel delivery pipe itself, so there is no measure against deformation caused by a difference in the coefficient of linear expansion between the fuel delivery pipe and the cylinder head. With the structure described in JP 2000-120504 A (p. 3 and FIG. 1), offset between the fuel delivery pipe and the cylinder head is reduced by reducing the difference in the thermal expansion at each portion by splitting up the fuel delivery pipe. However, because the fuel delivery pipe has been split up in this way, the strength of the fuel delivery pipe itself is reduced.

SUMMARY OF THE INVENTION

The invention provides a fastening structure of a fuel delivery pipe of an internal combustion engine and a cylinder head of the internal combustion engine, that is capable of mitigating deformation that accompanies a difference in thermal expansion between the fuel delivery pipe and the cylinder head, without reducing the strength of the fuel delivery pipe.

A first aspect of the invention relates to a fastening structure of a fuel delivery pipe and a cylinder head of an internal combustion engine, including three or more bosses provided on each of the cylinder head and the fuel delivery pipe, and a plurality of fastening portions formed by bolting the bosses on the cylinder head to the bosses on the fuel delivery pipe. The plurality of fastening portions are such that fastening portions positioned at both end portions of the fuel delivery pipe are less rigid than one or more fastening portions positioned in a middle between the fastening portions positioned at both end portions of the fuel delivery pipe.

According to this aspect, by setting the fastening portions at both end potions of the fuel delivery pipe to be less rigid than the one or more fastening portions in the middle, the amount of deformation of the fastening portions from stress is larger at both end portions of the fuel delivery pipe where stress concentrates due to a difference in thermal expansion between the cylinder head and the fuel delivery pipe than it is in the middle. As a result, the flexibility of the fastening portions at both end portions of the fuel delivery pipe is able to be increased.

Therefore, stress concentration at both end portions is able to be prevented even without splitting up the fuel delivery pipe, so deformation caused by a difference in thermal expansion between the fuel delivery pipe and the cylinder head can be mitigated without reducing the strength of the fuel delivery pipe.

The fastening structure described above may also include ribs that reinforce the bosses provided on the cylinder head or the bosses provided on the fuel delivery pipe. The ribs may be such that ribs positioned at both end portions of the fuel delivery pipe are thinner than one or more ribs positioned in the middle, or no ribs are positioned at both end portions of the fuel delivery pipe. As a result, the fastening portions at both end portions are easily able to be made less rigid.

In the fastening structure described above, diameters of the bosses on the cylinder head or diameters of the bosses on the fuel delivery pipe that are positioned at both end portions of the fuel delivery pipe may be smaller than a diameter of one or more bosses positioned in the middle. This structure enables the fastening portions at both end portions to be easily made less rigid.

In the fastening structure described above, a total boss height obtained by combining a height of a given one of the bosses on the cylinder head and a height of a corresponding one of bosses on the fuel delivery pipe may be greater with the bosses positioned at both end portions of the fuel delivery pipe than with the one or more bosses positioned in the middle.

When the total height of the bosses on the cylinder head and the bosses on the fuel delivery pipe is increased, as fastening portions, they are able to be more flexible and less rigid. Therefore, the fastening portions at both end portions are easily able to be made less rigid.

In the fastening structure described above, the cylinder head may be made of aluminum alloy.

The material of the cylinder head may be aluminum alloy that has low rigidity but a large coefficient of linear expansion. In this case, there is a tendency for the difference in thermal expansion between the cylinder head and the fuel delivery pipe to increase. However, as described above, stress concentration at both end portions is able to be prevented even without splitting up the fuel delivery pipe, so deformation caused by a difference in thermal expansion between the fuel delivery pipe and the cylinder head can be mitigated without reducing the strength of the fuel delivery pipe.

In the fastening structure described above, the fuel delivery pipe may be made of iron alloy.

The material of the fuel delivery pipe may be iron alloy that has a low coefficient of linear expansion but high rigidity. In this case, stress concentration tends to occur due to a difference in thermal expansion between the cylinder head and the fuel delivery pipe. However, as described above, stress concentration at both end portions is able to be prevented even without splitting up the fuel delivery pipe, so deformation caused by a difference in thermal expansion between the fuel delivery pipe and the cylinder head can be mitigated without reducing the strength of the fuel delivery pipe.

In the fastening structure described above, the cylinder head may be made of aluminum alloy, the fuel delivery pipe may be made of iron alloy, and a ratio of a height of a given one of the bosses on the cylinder head to a total boss height obtained by combining the height of the given one of the bosses on the cylinder head and a height of a corresponding one of the bosses on the fuel delivery pipe may be larger with the bosses positioned at both end portions of the fuel delivery pipe than with the one or more bosses positioned in the middle.

When material that is materially less rigid than the fuel delivery pipe is used for the cylinder head, lower rigidity at both end portions is easily able to be realized by increasing the ratio of the height of a given one of the bosses on the cylinder head to the total boss height.

In the fastening structure described above, the fastening structures positioned at both end portions of the fuel delivery pipe may be fastening portions that are positioned closest to ends of the fuel delivery pipe in an axial direction of the fuel delivery pipe, from among the plurality of fastening portions.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Structure of a First Example Embodiment

Figure 1A:
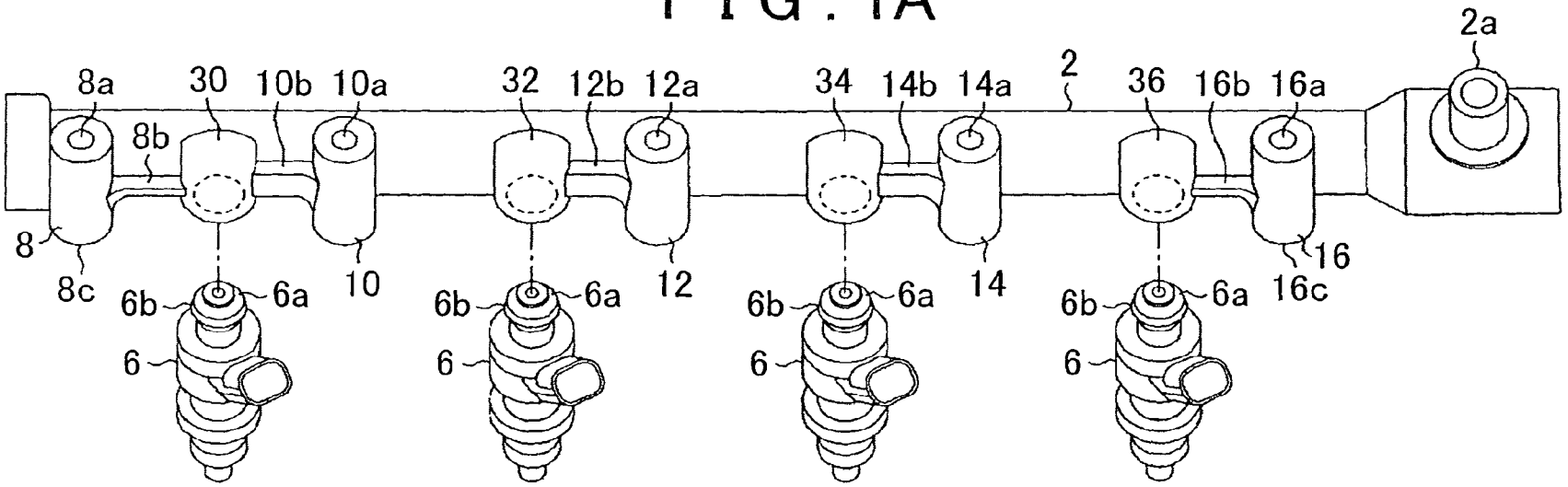
FIG. 1A is a perspective view of a fuel delivery pipe according to a first example embodiment of the invention.
Figure 1B:
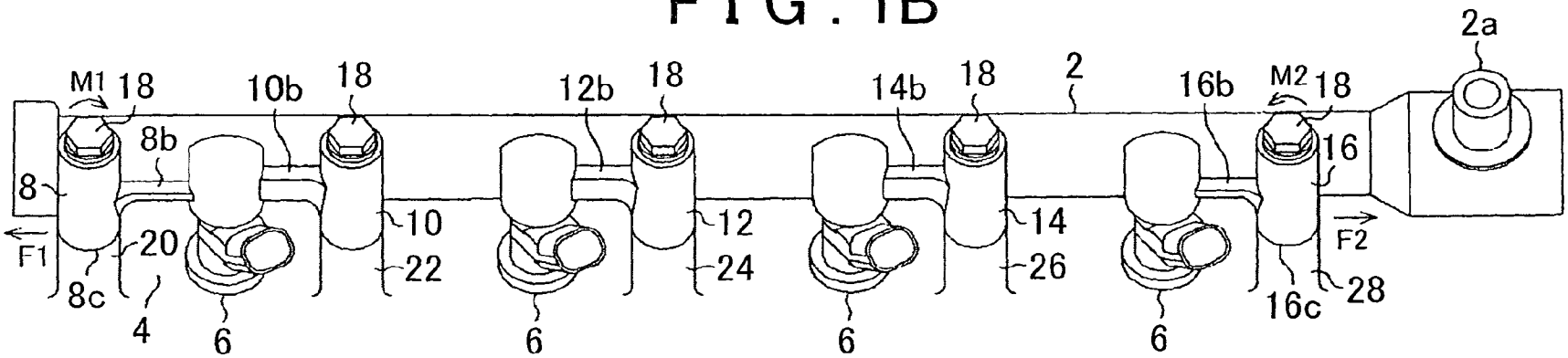
FIG. 1B is a perspective view of a cylinder head and the fuel delivery pipe according to the first example embodiment fastened together.

FIG. 1A is a view of a fuel delivery pipe 2 for a gasoline engine that is an internal combustion engine, and FIG. 1B is a view of the fuel delivery pipe 2 and a cylinder head 4 fastened together. This fuel delivery pipe 2 is made of iron alloy. The cylinder head 4 of the internal combustion engine to which this fuel delivery pipe 2 is attached is made of aluminum alloy. FIG. 1A is a view showing the structure of the fuel delivery pipe 2 and fuel injection valves 6 that are attached to the fuel delivery pipe 2, and FIG. 1B is a view showing the fuel delivery pipe 2 attached, together with the fuel injection valves 6, to the cylinder head 4.

The fuel injection valves 6 that are arranged in the cylinder head 4 are arranged such that a tip end of each fuel injection valve 6 is pointed toward an intake port or a combustion chamber. Fuel supplied from the fuel delivery pipe 2 to the fuel injection valve 6 is injected into the intake port or combustion chamber.

Fuel that has been pressurized by a fuel pump is supplied to a fuel passage inside the fuel delivery pipe 2 from a fuel inlet 2*a*. In particular, with a structure in which fuel is injected into the combustion chamber, cylinder internal pressure is applied directly to the tip end of the fuel injection valve 6. In order to inject fuel into the combustion chamber against this cylinder internal pressure, high-pressure fuel is supplied to the fuel delivery pipe 2 from a high-pressure pump.

The fuel delivery pipe 2 has five pipe bosses 8, 10, 12, 14, and 16 formed at intervals all the way across it (i.e., the fuel delivery pipe 2). Bolts 18 are screwed into screw holes in cylinder head bosses 20, 22, 24, 26, and 28 formed on the cylinder head 4 via bolt through-holes 8*a*, 10*a*, 12*a*, 14*a*, and 16*a* in these pipe bosses 8 to 16. As a result, the fuel delivery pipe 2 is fastened to the cylinder head 4. Accordingly, with the fuel delivery pipe 2 and the cylinder head 4, five fastening portions are formed by bolting the bosses 8 to 16 of the fuel delivery pipe 2 and the bosses 20 to 28 of the cylinder head 4 together.

Insertion portions 30, 32, 34, and 36 for attaching the fuel injection valves 6 are provided on the fuel delivery pipe 2. In this example embodiment, the internal combustion engine is an in-line four cylinder engine, so four of the insertion portions 30 to 36 are provided matching the number and arrangement of the cylinders. Rear end portions 6*a* of the fuel injection valves 6 are inserted and fit, together with O-rings 6*b*, into these insertion portions 30 to 36, as shown in FIG. 1A.

The pipe bosses 8 to 16 provided on the fuel delivery pipe 2 are reinforced by ribs 8*b*, 10*b*, 12*b*, 14*b*, and 16*b*. The thickness of these reinforcing ribs 8*b* to 16*b* differs, with the ribs 8*b* and 16*b* for the pipe bosses 8 and 16 at both end portions of the fuel delivery pipe 2 being thinner than the ribs 10*b*, 12*b*, and 14*b* for the pipe bosses 10, 12, and 14 in the middle.

Operation of the First Example Embodiment

The relationship between the thickness of the ribs 8*b* and 16*b* for the pipe bosses 8 and 16 at both end portions of the fuel delivery pipe 2 and the thickness of the ribs 10*b* to 14*b* for the pipe bosses 10 to 14 in the middle is set as described above. Therefore, the rigidity of the fastening portions that connect the fuel delivery pipe 2 and the cylinder head 4 together (i.e., of the structure in which the pipe bosses 8 to 16 are fastened to the cylinder head bosses 20 to 28 by the bolts 18) is set lower at both end potions of the fuel delivery pipe 2 than it is in the middle (i.e., in between the fastening portions at both end portions of the fuel delivery pipe).

As described above, the material of the cylinder head 4 is different from the material of the fuel delivery pipe 2, and the coefficient of linear expansion of the cylinder head 4 that is made of aluminum alloy is higher than the coefficient of linear expansion of the fuel delivery pipe 2 that is made of iron alloy. Therefore, when the internal combustion engine is started and the temperature of the internal combustion engine rises, the cylinder head 4 applies force in the expansion direction of the cylinder head (arrows F1 and F2 in FIG. 1B) to the fuel delivery pipe 2 via the fastening portions. As a result, stress is applied to the pipe bosses 8 to 16 via the bolts 18 and the cylinder head bosses 20 to 28.

This stress produces twisting moments M1 and M2 that bend the tip ends of the pipe bosses 8 to 16 toward the center. These moments M1 and M2 are larger in the pipe bosses 8 and 16 at both end portions than they are in the pipe bosses 10 to 14 in the middle.

If the pipe bosses 8 and 16 are strongly retained so that they will not twist, by the ribs 8*b* and 16*b* that reinforce the pipe bosses 8 and 16 at both end portions being the same thickness as the ribs 10*b* to 14*b* in the middle, the entire fuel delivery pipe 2 may rebound, so the sealing characteristic between the fuel injection valves 6 and the insertion portions 30 to 36 may decrease.

If the fuel delivery pipe 2 is rigid and will not rebound, fastening surfaces 8*c* and 16*c* of the pipe bosses 8 and 16 will become laterally offset and separate from the cylinder head bosses 20 and 28. If a condition in which this kind of offset and separation occurs at a high temperature and then the fastening surfaces 8*c* and 16*c* of the pipe bosses 8 and 16 cool and return to their original positions again when the internal combustion engine is stopped occurs repeatedly, the bolts 18 will loosen and the durability of the fastening portions will decrease.

In this example embodiment, the ribs 8*b* and 16*b* that reinforce the pipe bosses 8 to 16 at both end portions are thinner than the ribs 10*b* to 14*b* in the middle. That is, the fastening portions where the pipe bosses 8 to 16 positioned at both end potions of the fuel delivery pipe 2 are fastened to the cylinder head bosses 20 and 28 by the bolts 18 are less rigid than the fastening portions in the middle of the fuel delivery pipe 2.

As a result, when the pipe bosses 8 to 16 at both end portions receive force from the cylinder head 4 that pulls them away from the bosses 20 and 28 of the cylinder head 4 due to a difference in thermal expansion, the pipe bosses 8 to 16 at both end portions flexibly deform with respect to the moments M1 and M2 shown in FIG. 1B, and twist such that the tip ends thereof largely bend toward the middle.

Therefore, the fastening surfaces 8*c* and 16*c* of the pipe bosses 8 to 16 at both end portions of the fuel delivery pipe 2 constantly remain closely contacting the cylinder head bosses 20 and 28, without becoming laterally offset or separating from them (i.e., the cylinder head bosses 20 and 28). As a result, the bolts 18 will not loosen.

Effects of the First Example Embodiment

With this example embodiment, in the fastening of the fuel delivery pipe 2 and the cylinder head 4, lower rigidity of the fastening portions at both end portions of the fuel delivery pipe 2 is realized by making the ribs 8*b* and 16*b* that reinforce the pipe bosses 8 to 16 thinner.

By setting the fastening portions at both end portions of the fuel delivery pipe 2 to be less rigid than the fastening portions in the middle, the amount of deformation from stress on the fastening portions of the fuel delivery pipe 2 that is caused by a difference in thermal expansion between the cylinder head 4 and the fuel delivery pipe 2 is able to be larger at both end portions than it is in the middle. That is, the flexibility of the fastening portions at both end portions of the fuel delivery pipe 2 is able to be increased.

Therefore, stress concentration at both end portions is able to be prevented even without splitting up the fuel delivery pipe 2, so deformation caused by a difference in thermal expansion between the fuel delivery pipe 2 and the cylinder head 4 can be mitigated without reducing the strength of the fuel delivery pipe 2.

Furthermore, as a result, the entire fuel delivery pipe 2 will not rebound, so the sealing characteristic of the fuel injection valves 6 and the fuel delivery pipe 2 can be maintained. Also, stress will not concentrate at the fastening portions of the cylinder head 4 and the fuel delivery pipe 2, so durability can be maintained.

Structure of a Second Example Embodiment

Figure 2A:
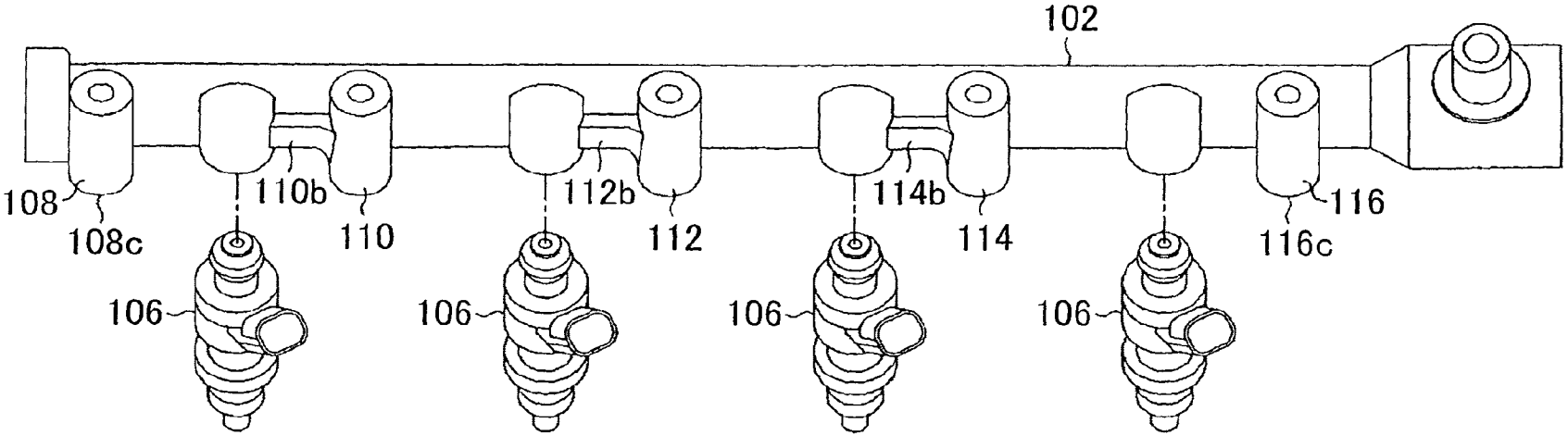
FIG. 2A is a perspective view of a fuel delivery pipe according to a second example embodiment of the invention.
Figure 2B:
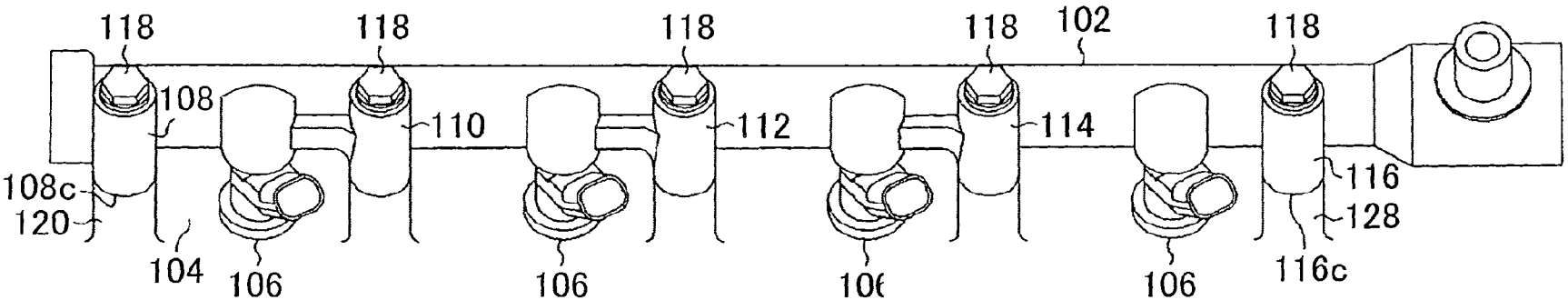
FIG. 2B is a perspective view of a cylinder head and the fuel delivery pipe according to the second example embodiment fastened together.

A fuel delivery pipe 102 according to a second example embodiment differs from the fuel delivery pipe 2 of the first example embodiment in that pipe bosses 108 and 116 at both end portions have no ribs, as shown in FIGS. 2A and 2B. The other structure is the same as it is in the first example embodiment.

Operation of the Second Example Embodiment

In this example embodiment, ribs 110*b*, 112*b*, and 114*b* that reinforce pipe bosses 110, 112, and 114 in the middle are provided, but no reinforcing ribs are provided for pipe bosses 108 and 116 at both end portions. As a result, fastening portions formed by fastening the pipe bosses 108 and 116 that are positioned at both end potions of the fuel delivery pipe 102 to cylinder head bosses 120 and 128 with bolts 118 are less rigid than fastening portions in the middle.

By making the pipe bosses 108 and 116 at both end portions less rigid than the pipe bosses 8 and 16 at both end portions in the first example embodiment, when the pipe bosses 108 and 116 receive force from the cylinder head 104 that pulls them away from the cylinder head 104 due to a difference in thermal expansion between the pipe bosses 108 and 116 and the cylinder head 104, the pipe bosses 108 and 116 twist such that the tip ends thereof bend toward the middle a particularly large amount.

Therefore, fastening surfaces 108*c* and 116*c* of the pipe bosses 108 to 116 at both end portions of the fuel delivery pipe 102 constantly remain closely contacting the cylinder head bosses 120 and 128, without becoming laterally offset or separating from them (i.e., the cylinder head bosses 120 and 128). As a result, the bolts 118 will not loosen.

Effects of the Second Example Embodiment

With this example embodiment, in the fastening of the fuel delivery pipe 102 and the cylinder head 104, lower rigidity at both end portions of the fuel delivery pipe 2 is realized by omitting ribs that reinforce the pipe bosses 108 to 116.

By setting the fastening portions to be much less rigid at both end potions of the fuel delivery pipe 102 than they are in the middle, the amount of deformation of the fastening portions from stress is able to be made much larger at both end portions than it is in the middle. That is, the flexibility of the fastening portions at both end portions of the fuel delivery pipe 102 is able to be greatly increased.

Therefore, stress concentration at both end portions is able to be prevented even without splitting up the fuel delivery pipe 102, so deformation caused by a difference in thermal expansion between the fuel delivery pipe 102 and the cylinder head 104 can be mitigated without reducing the strength of the fuel delivery pipe 102.

As a result, the entire fuel delivery pipe 102 will not rebound, so the sealing characteristic of the fuel injection valves 106 and the fuel delivery pipe 102 can be maintained. Also, stress will not concentrate at the fastening portions of the cylinder head 104 and the fuel delivery pipe 102, so durability can be maintained.

Structure of a Third Example Embodiment

Figures 3A, 3B, 3C:
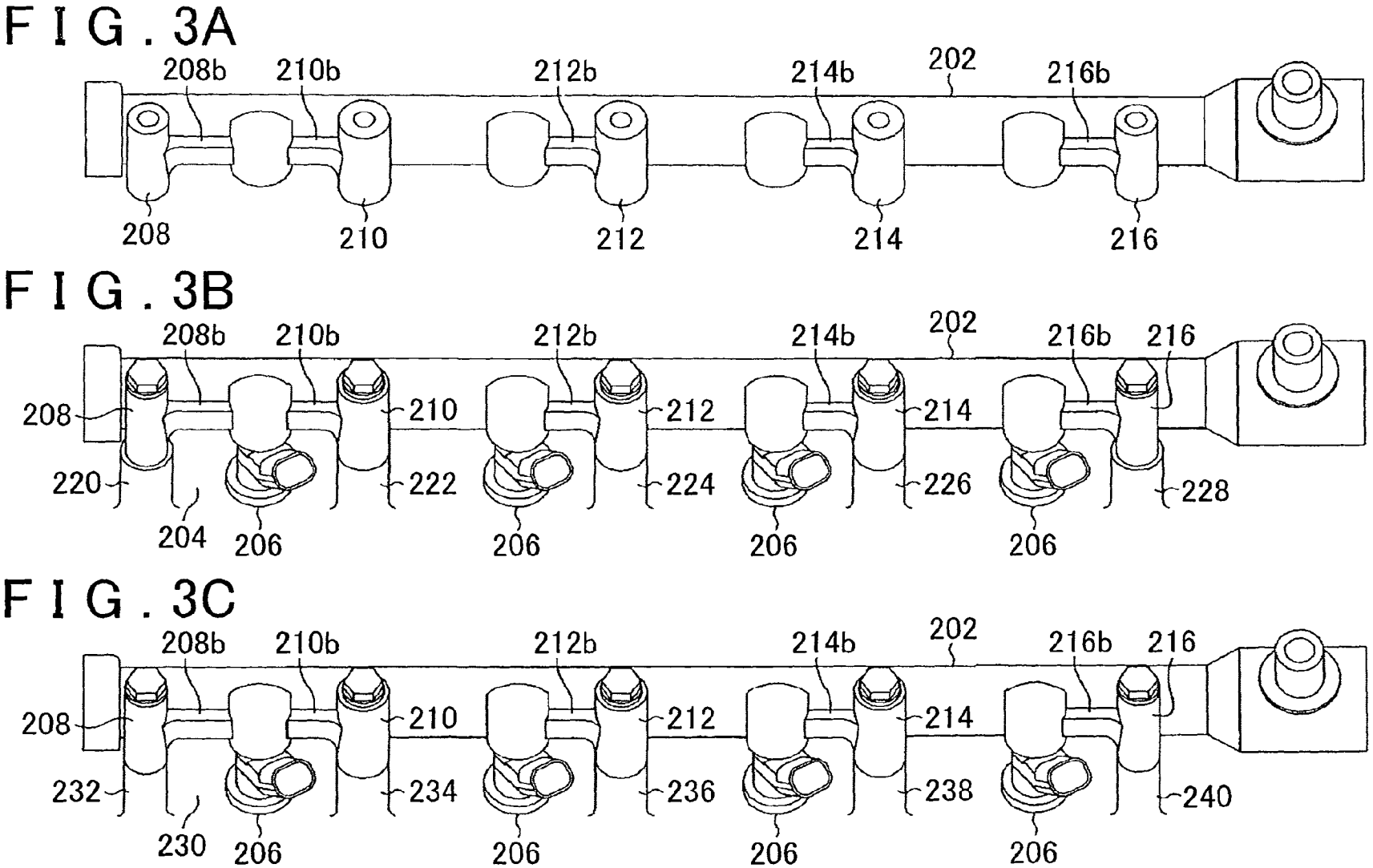
FIG. 3A is a perspective view of a fuel delivery pipe according to a third example embodiment of the invention.
FIG. 3B is a perspective view of a cylinder head and the fuel delivery pipe according to the third example embodiment fastened together.
FIG. 3C is a perspective view of another cylinder head and the fuel delivery pipe according to the third example embodiment fastened together.

A fuel delivery pipe 202 according to a third example embodiment is provided with ribs 208*b* and 216*b* for pipe bosses 208 and 216 at both end portions as shown in FIG. 3B. These ribs 208*b* and 216*b* are the same thickness as ribs 210*b*, 212*b*, and 214*b* of pipe bosses 210, 212, and 214 in the middle.

Diameters of the pipe bosses 208 and 216 at both end portions are smaller than diameters of the pipe bosses 210 to 214 in the middle. The other structure is the same as it is in the first example embodiment.

Operation of the Third Example Embodiment

Heights of the pipe bosses 208 and 216 at both end portions of the fuel delivery pipe (i.e., the lengths in the longitudinal direction of the bosses in the direction in which the bolts fasten) are the same as the heights of the pipe bosses 210 to 214 in the middle, but the diameters of the pipe bosses 208 and 216 at both end portions are smaller than the diameters of the pipe bosses 210 to 214 in the middle.

Therefore, the fastening portions at both end portions of the fuel delivery pipe 202 are made to be less rigid than the fastening portions in the middle. As a result, the amount of deformation from stress on the fastening portions of the fuel delivery pipe 202 that is caused by a difference in thermal expansion between the cylinder head 204 and the fuel delivery pipe 202 is able to be larger at both end portions than it is in the middle. That is, the flexibility of the fastening portions at both end portions of the fuel delivery pipe 2 is able to be greatly increased.

Cylinder head bosses 220, 222, 224, 226, and 228 of the cylinder head 204 shown in FIG. 3B are all the same height and all the same diameter. Instead, cylinder head bosses 232 and 240 corresponding to the pipe bosses 208 and 216 at both end portions of the fuel delivery pipe 202 may also have smaller diameters than cylinder head bosses 234, 236, and 238 in the middle, as shown in FIG. 3C.

As a result, the fastening portions at both end portions of the fuel delivery pipe 202 (i.e., the fastening structures of the pipe bosses 208 and 216 and the cylinder head bosses 232 and 240) may be even less rigid than the fastening portions shown in FIG. 3B.

Effects of the Third Example Embodiment

With this example embodiment, in the fastening of the fuel delivery pipe 202 and the cylinder head 204 and 230, lower rigidity of the fastening portions at both end portions of the fuel delivery pipe 202 is realized by reducing the diameters of the fastening portions (i.e., the pipe bosses 208 and 216, or both the pipe bosses 208 and 216 and the cylinder head bosses 232 and 240).

Therefore, just as in the first example embodiment described above, stress concentration at both end portions is able to be prevented even without splitting up the fuel delivery pipe 202, so deformation caused by a difference in thermal expansion between the fuel delivery pipe 202 and the cylinder head 204 and 230 can be mitigated without reducing the strength of the fuel delivery pipe 202.

Furthermore, the entire fuel delivery pipe 202 will not rebound, so the sealing characteristic of the fuel injection valves 206 and the fuel delivery pipe 202 can be maintained. Also, stress will not concentrate at the fastening portions of the cylinder head 204 and 230 and the fuel delivery pipe 202, so durability can be maintained.

Structure of a Fourth Example Embodiment

Figure 4A:
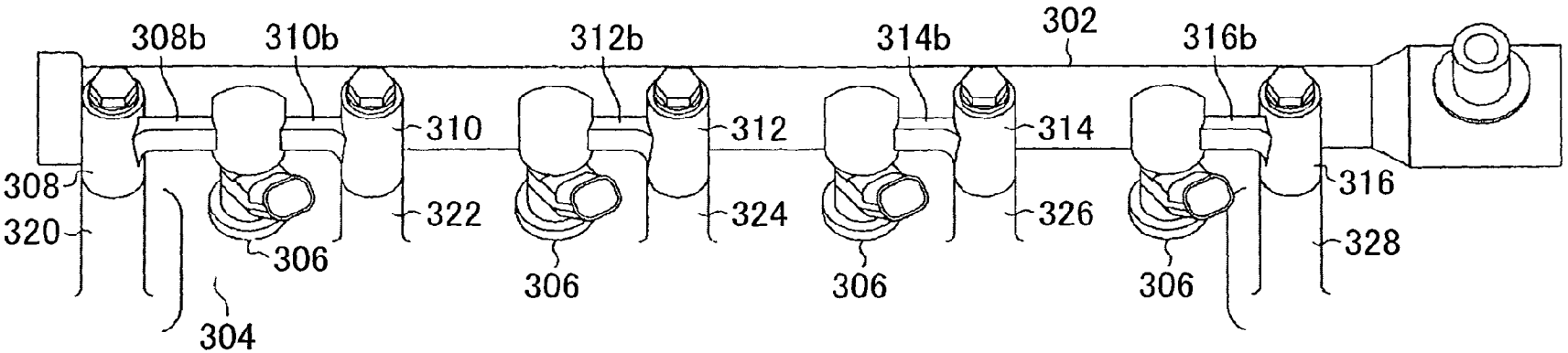
FIG. 4A is a perspective view of a cylinder head and a fuel delivery pipe according to a fourth example embodiment of the invention fastened together.
Figure 4B:
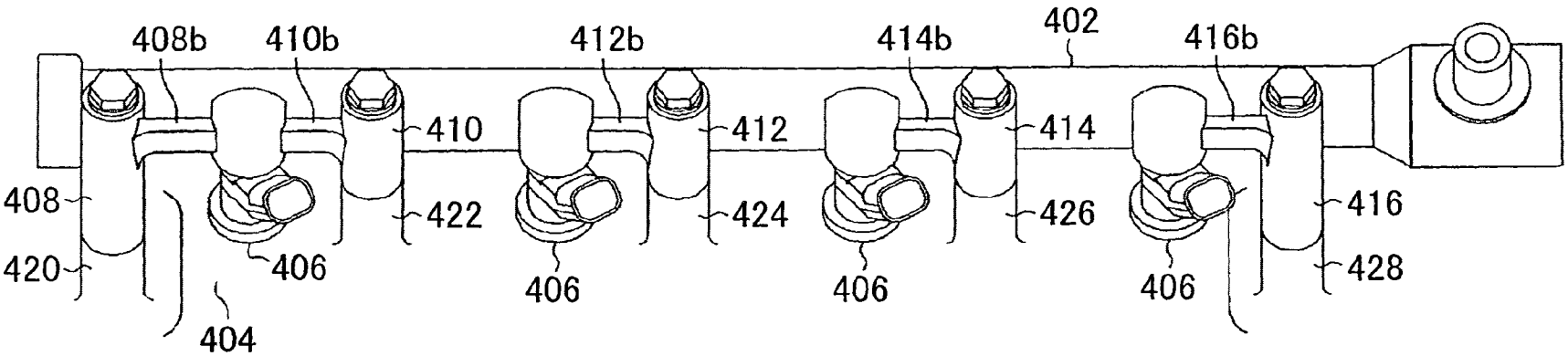
FIG. 4B is a perspective view of another cylinder head and the fuel delivery pipe according to the fourth example embodiment fastened together.

Fastening portions according to a fourth example embodiment are as shown in FIGS. 4A and 4B.

With a fuel delivery pipe 302 shown in FIG. 4A, ribs 308*b* and 316*b* provided for pipe bosses 308 and 316 at both end portions have the same thickness as ribs 310*b*, 312*b*, and 314*b* of pipe bosses 310, 312, and 314 in the middle. The diameters and lengths of the pipe bosses 308 and 316 at both end portions are the same as the diameters and lengths of the pipe bosses 310, 312, and 314 in the middle, just as in the first example embodiment.

The heights of the cylinder head bosses 320, 322, 324, 326, and 328 are different. The heights of the cylinder head bosses 320 and 328 that correspond to the pipe bosses 308 and 316 at both end portions of the fuel delivery pipe 302 (i.e., the length in the longitudinal direction of the bosses in the direction in which the bolts fasten) are made greater than the heights of the cylinder head bosses 322, 324, and 326 that correspond to the middle bosses 310, 312, and 314 of the fuel delivery pipe 302. The top portions of all of the cylinder head bosses 320 to 328 are in the same position in the height direction.

In a fuel delivery pipe 402 shown in FIG. 4B, the thicknesses of ribs 408*b*, 410*b*, 412*b*, 414*b*, and 416*b* of pipe bosses 408, 410, 412, 414, and 416 are all the same. The diameters of the pipe bosses 408 and 416 at both end portions are the same as the diameters of the pipe bosses 410, 412, and 414 in the middle. However, the heights of the pipe bosses 408 and 416 at both end portions (i.e., the lengths in the longitudinal direction of the bosses in the direction in which the bolts fasten) are greater than the heights of the pipe bosses 410, 412, and 414 in the middle.

The heights of the cylinder head bosses 420, 422, 424, 426, and 428 (i.e., the lengths in the longitudinal direction of the bosses in the direction in which the bolts fasten) are all the same. The positions of the cylinder head bosses 420 to 428 in the height direction are adjusted to correspond to the positions of bottom portions of the pipe bosses 408 to 416.

Operation of the Fourth Example Embodiment

The total heights of the pipe bosses 308 to 316 and the cylinder head bosses 320 to 328 and 420 to 428 are greater at both end portions of the fuel delivery pipe 302 and 402 than they are in the middle.

Accordingly, the fastening portions are set to be less rigid at both end potions of the fuel delivery pipe 302 and 402 than they are in the middle. Therefore, the amount of deformation from stress on the fastening portions of the fuel delivery pipe 302 and 402 that is caused by a difference in thermal expansion between the cylinder head 304 and 404 and the fuel delivery pipe 302 and 402 is able to be larger at both end potions than it is in the middle. That is, the flexibility of the fastening portions at both end portions of the fuel delivery pipe 302 and 402 is able to be increased.

Effects of the Example Embodiment

In this example embodiment, in the fastening of the fuel delivery pipe 302 and 402 and the cylinder head 304 and 404, lower rigidity at both end portions of the fuel delivery pipe 302 and 402 is realized by increasing the total height of the fastening portions at both end portions of the fuel delivery pipe 302 and 402.

Therefore, just as in the first example embodiment described above, stress concentration at both end portions is able to be prevented even without splitting up the fuel delivery pipe 302 and 402, so deformation caused by a difference in thermal expansion between the fuel delivery pipe 302 and 402 and the cylinder head 304 and 404 can be mitigated without reducing the strength of the fuel delivery pipe 302 and 402.

Furthermore, the entire fuel delivery pipe 302 and 402 will not rebound, so the sealing characteristic of the fuel injection valves 306 and 406 and the fuel delivery pipe 302 and 402 can be maintained. Also, stress will not concentrate at the fastening portions of the cylinder head 304 and 404 and the fuel delivery pipe 302 and 402, so durability can be maintained.

Structure of a Fifth Example Embodiment

Figure 5:
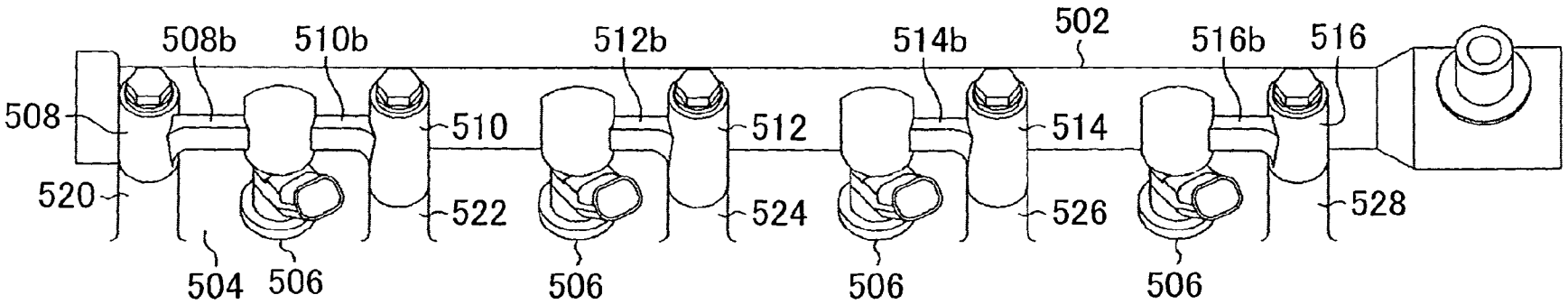
FIG. 5 is a perspective view of a cylinder head and a fuel delivery pipe according to a fifth example embodiment of the invention fastened together.

Fastening portions according to a fifth example embodiment are as shown in FIG. 5. With a fuel delivery pipe 502 shown in FIG. 5, ribs 508*b* and 516*b* provided for pipe bosses 508 and 516 at both end portions have the same thickness as ribs 510*b*, 512*b*, and 514*b* of pipe bosses 510, 512, and 514 in the middle. The diameters of the pipe bosses 508 and 516 at both end portions of the fuel delivery pipe 502 are the same as the diameters of the pipe bosses 510, 512, and 514 in the middle, but the heights of the pipe bosses 508 and 516 at both end portions (i.e., the lengths in the longitudinal direction of the bosses in the direction in which the bolts fasten) are lower than the heights of the pipe bosses 510, 512, and 514 in the middle. These pipe bosses 508 to 516 are formed such that the positions of the top portions in the height direction are all consistent.

In the cylinder head 504, the heights from the cylinder head 504 of the cylinder head bosses 520 and 528 that correspond to the pipe bosses 508 and 516 at both end portions of the fuel delivery pipe 502 (i.e., the lengths in the longitudinal direction of the bosses in the direction in which the bolts fasten) are greater than the heights from the cylinder head 504 of the cylinder head bosses 522, 524, and 526 that correspond to the middle.

Also, the total heights of the five fastening portions formed by the connection of the pipe bosses 508 to 516 with the corresponding cylinder head bosses 520 to 528 (i.e., the lengths in the longitudinal direction of the bosses in the direction in which the bolts fasten) are all the same.

Therefore, the ratio of the heights of the cylinder head bosses 520 and 528 to the total heights of the fastening portions at both end portions of the fuel delivery pipe is larger than the ratio of the heights of the cylinder head bosses 522, 524, and 526 to the total heights of the fastening portions in the middle.

Operation of the Fifth Example Embodiment

The ratio of the heights the cylinder head bosses 520 and 528 to the heights of the pipe bosses 508 and 516 of the fastening portions at both end portions of the fuel delivery pipe 502 is greater than the ratio of the heights of the cylinder head bosses 522, 524, and 526 to the heights of the pipe bosses 510, 512, and 514 of the fastening portions in the middle. The fuel delivery pipe 502 is made of iron alloy and the cylinder head 504 is made of aluminum alloy. That is, ratio of aluminum alloy is larger at the fastening portions at both end portions of the fuel delivery pipe 502, so the rigidity there is less it is in the middle.

Effects of the Fifth Example Embodiment

In the fastening of the fuel delivery pipe 502 and the cylinder head 504, lower rigidity at both end portions of the fuel delivery pipe 502 is realized by increasing the ratio of the cylinder head bosses 520 and 528 to the total heights of the fastening portions.

Therefore, just as in the first example embodiment described above, stress concentration at both end portions is able to be prevented even without splitting up the fuel delivery pipe 502, so deformation caused by a difference in thermal expansion between the fuel delivery pipe 502 and the cylinder head 504 can be mitigated without reducing the strength of the fuel delivery pipe 502.

Furthermore, the entire fuel delivery pipe 502 will not rebound, so the sealing characteristic of the fuel injection valves 506 and the fuel delivery pipe 502 can be maintained. Also, stress will not concentrate at the fastening portions of the cylinder head 504 and the fuel delivery pipe 502, so durability can be maintained.

Other Example Embodiments

The structures that reduce the rigidity of the fastening portions of the example embodiments described above may also be combined. This enables the rigidity to be further reduced.

In the example embodiments described above, the fuel delivery pipe is made of iron alloy, and the cylinder head is made of aluminum alloy, but a combination of materials other than this may also be used. Even if the fuel delivery pipe and the cylinder head are made of the same material, a difference in thermal expansion will occur due to a difference in temperature. Therefore, even if the fuel delivery pipe and the cylinder head are made of the same material, the fastening portions at both end portions of the fuel delivery pipe can be made less rigid than the fastening portions in the middle by employing the structures illustrated in the first to the fifth example embodiments described above. As a result, deformation caused by a difference in thermal expansion between the fuel delivery pipe and the cylinder head can be mitigated without reducing the strength of the fuel delivery pipe.

The invention claimed is:

1. A fastening structure of a fuel delivery pipe and a cylinder head of an internal combustion engine, the fastening structure comprising:

three or more bosses provided on each of the cylinder head and the fuel delivery pipe;

a plurality of fastening portions formed by bolting the bosses on the cylinder head to the bosses on the fuel delivery pipe; and ribs that reinforce the bosses provided on the cylinder head or the bosses provided on the fuel delivery pipe, wherein the plurality of fastening portions are such that fastening portions positioned at both end portions of the fuel delivery pipe are less rigid than one or more fastening portions positioned in a middle between the fastening portions positioned at both end portions of the fuel delivery pipe, wherein the ribs positioned at both end portions of the fuel delivery pipe are thinner than one or more ribs positioned in the middle, or no ribs are positioned at both end portions of the fuel delivery pipe.

2. The fastening structure according to claim 1, wherein the cylinder head is made of aluminum alloy.

3. The fastening structure according to claim 1, wherein the fuel delivery pipe is made of iron alloy.

4. The fastening structure according to claim 1, wherein the fastening structures positioned at both end portions of the fuel delivery pipe are fastening portions that are positioned closest to ends of the fuel delivery pipe in an axial direction of the fuel delivery pipe, from among the plurality of fastening portions.

5. A fastening structure of a fuel delivery pipe and a cylinder head of an internal combustion engine, the fastening structure comprising:

three or more bosses provided on each of the cylinder head and the fuel delivery pipe; and a plurality of fastening portions formed by bolting the bosses on the cylinder head to the bosses on the fuel delivery pipe, wherein the plurality of fastening portions are such that fastening portions positioned at both end portions of the fuel delivery pipe are less rigid than one or more fastening portions positioned in a middle between the fastening portions positioned at both end portions of the fuel delivery pipe, wherein diameters of the bosses on the cylinder head or diameters of the bosses on the fuel delivery pipe that are positioned at both end portions of the fuel delivery pipe are smaller than a diameter of one or more bosses positioned in the middle.

6. The fastening structure according to claim 5, wherein the cylinder head is made of aluminum alloy.

7. The fastening structure according to claim 5, wherein the fuel delivery pipe is made of iron alloy.

8. The fastening structure according to claim 5, wherein the fastening structures positioned at both end portions of the fuel delivery pipe are fastening portions that are positioned closest to ends of the fuel delivery pipe in an axial direction of the fuel delivery pipe, from among the plurality of fastening portions.

9. A fastening structure of a fuel delivery pipe and a cylinder head of an internal combustion engine, the fastening structure comprising:

three or more bosses provided on each of the cylinder head and the fuel delivery pipe; and a plurality of fastening portions formed by bolting the bosses on the cylinder head to the bosses on the fuel delivery pipe, wherein the plurality of fastening portions are such that fastening portions positioned at both end portions of the fuel delivery pipe are less rigid than one or more fastening portions positioned in a middle between the fastening portions positioned at both end portions of the fuel delivery pipe, wherein a total boss height obtained by combining a height of a given one of the bosses on the cylinder head and a height of a corresponding one of the bosses on the fuel delivery pipe is greater with the bosses positioned at both end portions of the fuel delivery pipe than with the one or more bosses positioned in the middle.

10. The fastening structure according to claim 9, wherein the cylinder head is made of aluminum alloy.

11. The fastening structure according to claim 9, wherein the fuel delivery pipe is made of iron alloy.

12. The fastening structure according to claim 9, wherein the fastening structures positioned at both end portions of the fuel delivery pipe are fastening portions that are positioned closest to ends of the fuel delivery pipe in an axial direction of the fuel delivery pipe, from among the plurality of fastening portions.

13. A fastening structure of a fuel delivery pipe and a cylinder head of an internal combustion engine, the fastening structure comprising:

three or more bosses provided on each of the cylinder head and the fuel delivery pipe; and a plurality of fastening portions formed by bolting the bosses on the cylinder head to the bosses on the fuel delivery pipe, wherein the plurality of fastening portions are such that fastening portions positioned at both end portions of the fuel delivery pipe are less rigid than one or more fastening portions positioned in a middle between the fastening portions positioned at both end portions of the fuel delivery pipe, wherein the cylinder head is made of aluminum alloy; the fuel delivery pipe is made of iron alloy; and a ratio of a height of a given one of the bosses on the cylinder head to a total boss height obtained by combining the height of the given one of the bosses on the cylinder head and a height of a corresponding one of the bosses on the fuel delivery pipe is larger with the bosses positioned at both end portions of the fuel delivery pipe than with the one or more bosses positioned in the middle.

14. The fastening structure according to claim 13, wherein the fastening structures positioned at both end portions of the fuel delivery pipe are fastening portions that are positioned closest to ends of the fuel delivery pipe in an axial direction of the fuel delivery pipe, from among the plurality of fastening portions.

* * * * *